United States Patent [19]

Ruhle

[11] Patent Number: 4,825,963

[45] Date of Patent: May 2, 1989

[54] HIGH-PRESSURE WATERJET/ABRASIVE PARTICLE-JET CORING METHOD AND APPARATUS

[76] Inventor: James L. Ruhle, P.O. Box 4301, Fullerton, Calif. 92634

[21] Appl. No.: 221,643

[22] Filed: Jul. 11, 1988

[51] Int. Cl.[4] ..... E21B 10/02; E21B 25/02

[52] U.S. Cl. ..... 175/60; 175/236; 175/248; 175/404

[58] Field of Search ..... 175/20, 58, 60, 67, 175/236, 239, 244, 246, 247, 248, 403, 404, 424; 299/17

[56] References Cited

U.S. PATENT DOCUMENTS 4,679,636 7/1987 Ruhle ..... 175/248 X

*Primary Examiner*—William P. Neuder

[57] ABSTRACT

A simple low-cost and highly passive bitless nonrotational nondeviating jam-proof thin-kerf Newtonian hydraulics retrievable core-sampling method and apparatus that advances its circular core kerf through the rock by a combination of high-pressure droplet-impact and abrasive particle-jet effects, and which is independent of the weight of any drillpipe, drill collars, or any other heavy cylindrical conduit or tubular conduit associated with the coring operation. The Newtonian hydraulics features high-pressure solids-free fresh water or solution-weighted brine as the drilling fluid, which excavates rock along the inner periphery of the circular core kerf by droplet-impact effects of the high-pressure and high-velocity circular sheet of drilling fluid and by the abrasive particle-jet effects of the deflected drilling fluid and excavated rock particles along the outer periphery of the circular core kerf. The hydraulic horsepower delivered to the downhole coring apparatus and the hydraulic hoisting capacity of the excavated rock particles to the surface can both be increased considerably by employing high-density solution-weighted brine as the drilling fluid. The use of solution-weighted brine, if chilled at the surface to below the freezing point of the penetrated porefluid, and if circulated in the borehole by means of insulated drillpipe, would also provide the additional advantage of freeze-stabilizing the borehole wall, freeze-stabilizing the excavated core samples, and freeze-entrapment of uncontaminated porefluids in the core samples.

2 Claims, 1 Drawing Sheet

HIGH-PRESSURE WATERJET/ABRASIVE PARTICLE-JET CORING METHOD AND APPARATUS

BACKGROUND OF THE INVENTION

Figure 1:
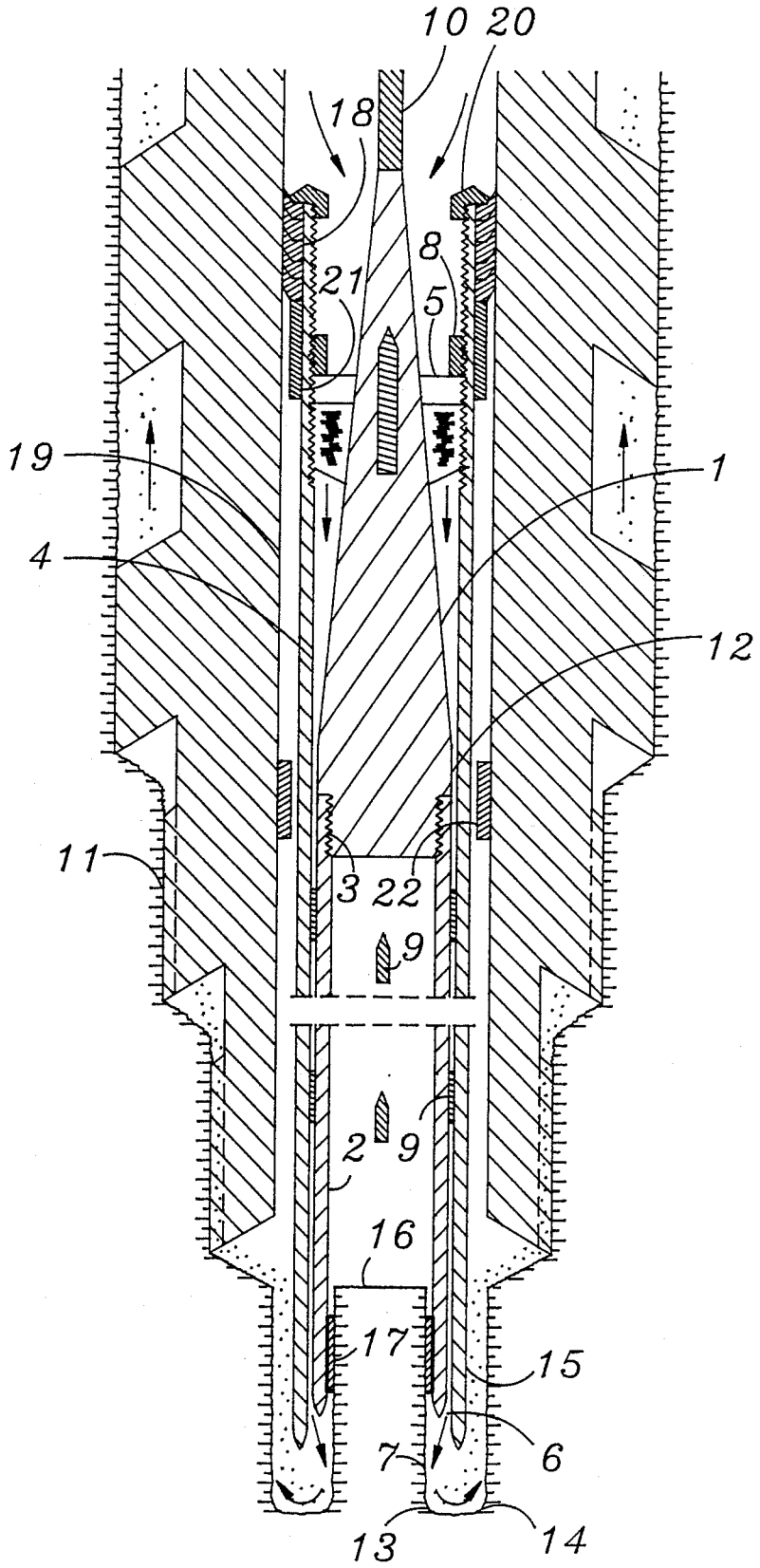

Rotational coring systems employed by the oil and gas industry, the geothermal-energy industry, and the mining industry all employ a nonrotating inner core barrel/rotating outer core barrel configuration with a swivel bearing connection at the top of the dual-concentric core barrel, whereas kerf excavation is provided by either roller cone, roller wheel, or drag-type core-bit configurations. Because of the rotational kinetics associated with state-of-the-art core bits and because of internal wear, or internal gauge loss, torsional loads are often placed upon the emerging core, resulting in the fracture and rotation of the core by the core bit, ultimately, leading to core-jamming at the core catcher assembly, whereas natural fractures as well as core-bit induced fractures often result in wedge-jamming within the core barrel itself.

Small-diameter lightweight coring systems, particularly, the wire-line conveyed core-sampling apparatus employed by the mining industry, have a tendency while progressing downward through the rock to deviate considerably because of the inadvertent application of excessive weight upon the light-duty coring equipment. Consequently, deviation of the corehole trajectory from the vertical often becomes excessive, thus, necessitating costly remedial measures directed at reducing the corehole deviation to within acceptable limits.

Furthermore, if the down-hole coring apparatus is driven to the right, or clockwise, by a downhole motor, as viewed from above, the reactive torque transmitted from the face of the diamond-impregnated core bit (or any other high-friction drag-type cutting head) to the downhole motor, results in a corehole deviation pattern that spirals to the left, or counterclockwise, as portrayed by the trace of the corehole trajectory on a horizontal plane. In the parlance of the trade, this downhole lateral force is referred to as "left-hand torque", and the downhole motor is said to "crank to the left", whereas the course of the corehole is said to "walk to the left". In down-hole coring operations, particularly, those that must be performed with minimal corehole deviation, a coring system that prevents the inadvertent application of excessive amounts of weight upon the light-duty coring apparatus, a coring system that is capable of eliminating corehole deviation induced by reactive torque, and a coring system that is able to minimize geologically-induced corehole deviation, would be particularly desirable.

SUMMARY OF INVENTION

It is among the objects of the invention to provide a new and improved coring apparatus and process that eliminates torsional loads on the core, eliminates core rotation, reduces the frequency of core-jamming at the core-catcher assembly and within the core barrel, and eliminates reactive-torque deviation effects created by downhole motors.

Another object of the invention is to provide a new and improved coring apparatus and process which prevents the application of excessive weight from associated heavy cylindrical components to the light-duty coring apparatus that otherwise might cause excessive corehole deviation.

Still another object of the invention is to provide a new and improved coring apparatus and process that may employ high-density solution-weighted brine to increase its hydraulic horsepower, increase the lifting capacity of its drilling fluid, and allow the drilling fluid to be used as a refrigerant, thus, freezing and stabilizing the borehole wall, the excavated core samples, and the porefluids within the borehole wall and the core samples.

Still another object of the invention is to provide a new and improved coring apparatus and process that does not require the use of expensive rotational core bits which must be hardfaced with costly abrasive-resistant materials, such as synthetic or natural diamonds.

With these and other objects in view, the invention consists in the arrangement and combination of the various process apparatus of the invention, whereby the objects contemplated are attained, as hereinafter set forth in the appended claims and accompanying drawings.

In the drawing:

FIG. 1 is a schematic longitudinal sectional view of the coring apparatus.

Drawing on a typical condition as an example in describing the apparatus and method, it can be assumed that the retrievable core-sampling apparatus depicted in FIG. 1 is deployed at the bottom of the hole through the central and axial bore of either a rotational or linear-motion hole-enlarging device, known in the trade as a "hole opener", and that said retrievable core-sampling apparatus employs a dual-concentric core barrel which excavates a core measuring approximately 2 inches in diameter, whereas the hole-opener enlarges the corehole to 9 inches in diameter.

The coring operation takes place ahead of the hole-opening operation until the core barrel is filled to capacity, after which the retrievable core-sampling assembly is retrieved at the surface, and the corehole is enlarged by the hole-opener, Circulation of the high-pressure Newtonian drilling fluid is in the normal manner during coring operations, with the drilling fluid descending through cylindrical conduit, or drillpipe, to the core-sampling assembly, and returning to the surface with its load of fine-grained core cuttings through the borehole annulus, whereas during hole-opening operations lower-pressure drilling fluid is circulated in the reverse direction, or down through the bore-hole annulus, returning to the surface up through the inside of the drillpipe with its load of coarse-grained hole-opener cuttings.

The retrievable core-sampler depicted in FIG. 1 is wire-line conveyed through the drillpipe between the ground surface and the bottom of the borehole. Wire-line conveyance is herein defined as the employment of a suitable metallic or nonmetallic cable, affixed to the top of the retrievable core-sampler by a suitable solid, swivel, or latch-type connection, said suitable cable employed to convey the retrievable core-sampler through the drillpipe and through the hollow-shaft hole-opener to the bottom of the borehole from the surface, or through the hollow-shaft hole-opener and through the drillpipe from the bottom of the borehole to the surface, or through the drillpipe and hollow-shaft hole-opener in both directions, and to accomplish this task with or without gravity-assist from weighted units, known in the trade as sinker bars, or with or without hydraulic-assist from the drilling fluid by suitable pumping means, said wireline conveyance system incorporating at the surface when necessary a suitable wire-line pack-off assembly for either hydraulically-assisted conveyance of the core-sampler to the bottom of the borehole, or during coring operations when high-pressure drilling fluid is pumped through the drillpipe to the core-sampler.

In an embodiment of the invention chosen for the purpose of illustration, there is shown in FIG. 1 a retrievable core-sampler composed of a tapered forebody, 1, rigidly affixed at its lower extremity to the nonrotational inner core barrel, 2, at the threaded connection, 3, and rigidly affixed near its upper extremity to the nonrotational outer core barrel, 4, by means of threaded fins, one of which is designated, 5, said threaded fins allowing the nonrotational inner core barrel, 2, to be adjusted in an axial manner with respect to the outer core barrel, 4, so as to adjust the angle of attack of the high-pressure waterjet annular nozzle, 6, with respect to the inner wall, 7, of the circular core kerf. The aforementioned threaded fins, rigidly affixed to the tapered forebody, 1, are locked permanently in the desired position by the threaded lock ring, 8, which prevents axial movement of the nonrotating inner core barrel, 2, with the latter centralized within the nonrotating outer core barrel, 4, by means of spacers, two of which are designated, 9, affixed to the exterior surface of the nonrotating inner core barrel, 2, whereas as the core-sampler wire-line conveyance cable is designated, 10.

High-pressure Newtonian drilling fluid is pumped through the inside of the drillpipe (not shown) by suitable pumping means, then descends through the hollow shaft hole-opener, 11, to the retrievable core-sampler where said high-pressure Newtonian drilling fluid passes through the aforementioned threaded fins and is then deflected radially outward by means of the tapered forebody, 1, into the narrow annulus, 12, between the nonrotating inner core barrel, 2, and the nonrotating outer core barrel, 4, ultimately, exiting the retrievable core sampler at the high-pressure waterjet annular nozzle, 6, where the high velocity sheet of high-pressure Newtonian drilling fluid excavates the inner periphery, 13, of the circular core kerf by droplet-impact effects, and is deflected radially outward toward the outer periphery, 14, of the circular core kerf, where excavation takes place by abrasive particle-jet effects, with the rock particles excavated from the inner periphery, 13, of the circular core kerf providing the abrasive effects at the outer periphery, 14, of the circular core kerf. The spent drilling fluid, with its load of fine-grained rock particles, is then circulated upward around the outside of the nonrotational outer core barrel, 4, hardfaced with tungsten carbide, 15, to resist abrasion, and then circulated upward around the outside of the hollow-shaft hole-opener, 11, and upward to the surface through the annulus between the drillpipe and the borehole wall (not shown).

As the kerf advances through the rock, and as the cored rock, 16, emerges upward through the nonrotating inner core barrel, 2, the cored rock, 16, is retained within the nonrotating inner core barrel, 2, by means of a suitable core catcher assembly, 17, whereas the descending high-pressure drilling fluid actuates the pressure-actuated seal, 18, affixed to the exterior of the nonrotating outer core barrel, 4, thus, preventing the descending high-pressure drilling fluid from entering the annulus between the nonrotating outer core barrel, 4, and the central and axial bore, 19, within the hole-opener, 11, whereas the pressure-actuated seal, 18, is retained at its upper extremity by the threaded retainer, 20, and is retained at its lower extremity by the upper lift shoulder, 21, affixed to the exterior of the nonrotating outer core barrel, 4. When the cored rock, 16, has filled the nonrotating inner core barrel, 2, to capacity, the cored rock, 16, is extracted from the core-hole by lifting the drillpipe and the attached hollow-shaft hole-opener, 11, so as to cause the lower part of the upper lift shoulder, 21, to engage, or butt against the upper part of the lower lift shoulder and core-barrel guide, 22, affixed to the axial and central bore, 19, within the hole-opener, 11, thus, providing sufficient force to allow the core-catcher assembly, 17, to break the cored rock, 16, at the core root. The retrievable core sampler, with its load of cored rock is then ready to be conveyed to the surface by means of the wire line, 10.

After retrieval at the surface of the core-sampler and its load of cored rock, the hollow-shaft hole-opener, 11, is actuated by the drillstring and low-pressure drilling fluid is circulated in the reverse manner, i.e., down the annulus and up through the hollow-shaft hole-opener bore, 19, and through the drillpipe so as to transport to the surface the coarse-grained rock particles resulting from the hole-opening operation.

In situations where chilled brine is employed as the drilling fluid, and where the porefluids in the borehole wall are frozen solid so as to create an impermeable sheath of stabilized and frozen rock surrounding the wellbore, thus, preventing the excessive loss of drilling fluid to the penetrated formations, retrieval of the core-sampler and its load of cored rock could be accomplished, if so desired, by hydraulic means, or pumped to the surface, employing a suitable surface pump and a suitable annular seal at the surface, with the drilling fluid circulated in the reverse-circulation manner. Such a procedure could be accomplished by closing the pipe rams and pumping the drilling fluid through the kill line, which is connected to the wellhead below the blow-out preventer, and thus circulating the drilling fluid in the reverse-circulation manner.

In situations where a linear-motion rather than a rotational hole-opener is employed, the use of axial/biaxial fiber-reinforced nonmetallic composite drillpipe of the type described in my Pat. No. 4,548,428 (Anti Back-Out Steel Coupling System for Nonmetallic Composite Pipe) would be particularly advantageous for this invention since the pipe wall could be custom-tailored to meet the specific mechanical and hydraulic requirements of both the coring and hole-opening operations. Such a custom-tailored drillstring would incorporate in the pipe wall an axial, or longitudinally-reinforced ply to meet the high-tensile-strength requirements of the linear-motion hole-opening operation and a biaxial, or circumferentially-reinforced ply to meet the high burst-strength requirements of the high-pressure waterjet/abrasive particle-jet coring operation, without the severe weight penalty that would, otherwise, accompany a string of equivalent-strength and equivalent I.D. steel drillpipe.

In situations where high-density solution-weighted brine is employed as the drilling fluid, the use of nonmetallic composite pipe would be particularly advantageous because of the corrosion-resistance of such a string of drillpipe, relative to a string of steel drillpipe. Progressive increases in the density of the solution-weighted brine would result, not only, in progressive increases in the hydraulic horsepower of the high-pressure waterjet/abrasive particle-jet core-sampler and progressive increases in the capacity of the drilling fluid to lift rock particles, but it would result, also, in the progressive reduction in the hook load, or suspended weight, of the nonmetallic composite pipe to the point where the latter would become nearly neutrally-buoyant at a brine commonly used in oil-field workover and completion operations.

In situations where nonmetallic composite pipe is employed as the drillstring and where chilled brine is employed as the drilling fluid, thus, creating an impermeable sheath of frozen rock around the wellbore, the reverse-circulation hole-opening operation could be accomplished at relatively high pump pressures and at relatively high flow rates by means of a suitable surface pump and a suitable stuffing box assembly at the surface without fear of losing large volumes of drilling fluid to the penetrated formations. Such a reverse-circulation hole-opening procedure would increase the drilling fluid velocity and the drilling fluid turbulence inside the drillpipe, and allow larger-diameter rock particles to be hydraulically-hoisted to the surface, thus, increasing the flushing action by the drilling fluid during the hole-opening operation.

Having described examples of employing the present invention, I claim:

1. The invention of a retrievable bitless Newtonian hydraulics high-pressure waterjet and abrasive particle-jet nonrotational thin-kerf core-sampling apparatus comprising:

a suitable conveyance system to convey said core-sampling apparatus through suitable cylindrical conduit to and from the bottom of a hole excavated in rock, said suitable cylindrical conduit positioned between said core-sampling apparatus and the ground surface, a tapered, or conical, forebody, with or without suitable weighted units, or sinker bars, incorporated therein, to which is rigidly affixed at its lower extremity a suitable nonrotational inner core barrel and to which is rigidly affixed near its upper extremity a plurality of threaded fins, said threaded fins, in turn, engaging a suitable nonrotational outer core barrel near its upper extremity, a means to adjust said tapered forebody and attached nonrotational inner core barrel in an axial manner with respect to said nonrotational outer corebarrel, said adjustment means consisting of said threaded fins, engaging threads within the upper extremity of said nonrotational outer core barrel, and threaded lock ring, a suitable hardfaced waterjet nozzle, bounded on the inside by the lower extremity of said nonrotational inner core barrel and bounded on the outside by the lower extremity of said nonrotational outer core barrel, said annular waterjet nozzle incorporating an incident-angle adjustment means, actuated by said threaded adjustment means so as to change the direction of the annular waterjet to the desired angle of incidence with respect to the inner wall of the excavated circular core kerf, a suitable core-catcher assembly affixed to the inside of said nonrotational inner core barrel near its lower extremity so as to grip the cored rock after said nonrotational inner core barrel is filled to capacity by said cored rock, sand so as to retain said cored rock within said nonrotational inner core barrel during retrieval, a suitable pressure-actuated seal, rigidly affixed to the exterior surface of said nonrotational outer core barrel at its upper extremity, said pressure-actuated seal actuated by drilling-fluid pressure so as to exclude downward-flowing Newtonian drilling fluid from the outside of said nonrotational outer core barrel, and direct said Newtonian drilling fluid into the narrow annulus between said nonrotational inner core barrel and said nonrotational outer core barrel, said pressure-actuated seal retained at its upper extremity by a suitable retainer, and retained at its lower extremity by a suitable external shoulder, or upper lift shoulder, affixed to the exterior surface of said nonrotational outer core barrel, a plurality of suitable spacers, rigidly affixed to the exterior surface of said nonrotational inner core barrel so as to centralize the latter within said nonrotational outer core barrel, a suitable hole-enlarging means, or hole-opener, operating in the linear-motion excavation mode, with said hole-opener containing a central and axial bore of sufficient diameter to allow the passage of the retrievable core-sampling assembly, a suitable internal shoulder, or lower lift shoulder and core-barrel guide, rigidly affixed to the interior surface of the central and axial bore of said hole-opener.

2. The invention of a retrievable bitless Newtonian hydraulics high-pressure waterjet and abrasive particle-jet nonrotational thin-kerf core-sampling method comprising the following procedure:

conveyance of the retrievable core-sampling assembly described in claim 1 by a suitable conveyance method through suitable cylindrical conduit from the ground surface to the bottom of a hole excavated in rock, circulating a suitable high-pressure Newtonian drilling fluid during coring operations by suitable pumping means at the surface so as to cause said drilling fluid to descend through said suitable cylindrical conduit to the retrievable core-sampling assembly, where said drilling fluid pressure-actuates said pressure-actuated seal and is directed by said tapered forebody through said threaded fins into and through the narrow annulus between said nonrotational inner core barrel and said non-rotational outer core barrel, said drilling fluid then expelled out the annular waterjet nozzle as a high-pressure high-velocity circular sheet of waterjet droplets, directed at the inner wall of the circular core kerf at the desired angle of incidence with the latter, where excavation of rock takes place by droplet-impact effects, said drilling fluid then deflected in a radially-outward manner toward the outer periphery of the circular core kerf where excavation of rock takes place by abrasive particle-jet effects provided by said drilling fluid and its load of fine-grained rock particles excavated from the inner periphery of the circular core kerf, said drilling fluid and its load of fine-grained rock particles then ascending the annulus between said nonrotational outer core barrel and the outer wall of the circular core kerf, then ascending around the outside of said hole-opener, and then ascending through the annulus between said cylindrical conduit and the borehole wall to the surface.

progressively advancing the retrievable core-sampling assembly downward through the central axial bore of said hole-opener and downward through the rock below by the hydraulic thrust created by the high-pressure Newtonian drilling fluid acting upon the retrievable core-sampling assembly, whereas said pressure-actuated seal continuously seals the annulus between the retrievable core-sampling assembly and the central and axial bore of said hole-opener, whereas the retrievable core-sampling assembly advances its circular kerf downward through the rock by a combination of droplet-impact effects and abrasive particle-jet effects, progressively causing to emerge into said nonrotational inner core barrel a core of rock, until said nonrotational inner core barrel is filled to capacity, hoisting, or lifting upward, at the surface said cylindrical conduit and attached hole-opener, thereby causing the bottom surface of the upper lift shoulder beneath said pressure-actuated seal to meet and butt against the top surface of the lower lift shoulder and core-barrel guide affixed to the central and axial bore of said hole-opener, thereby causing the core-catcher assembly, by continuous upward lifting of said cylindrical conduit and attached hole-opener, to grip the core of rock at its root in the conventional manner, retrieving at the surface the retrievable core-sampling assembly and its load of cored rock by a suitable conveyance method through said cylindrical conduit, enlarging each cored section of rock from top to bottom by means of said hole-opener, with excavation of rock taking place by linear-motion excavation mode, circulating drilling fluid during hole-opening operations by suitable pumping means at the surface so as to cause said drilling fluid to descend through the borehole annulus to the cutting blades of said hole-opener, said drilling fluid, with its load of coarse-grained hole-opener rock particles then flushed into the central and axial bore of said hole-opener, and then returning to the surface through said cylindrical conduit, repeating the above-described procedure that defines the retrievable high-pressure waterjet/abrasive particle-jet coring method until no more core samples are desired, circulating chilled brine as the drilling fluid, when conditions permit, or when desirable with suitable insulated cylindrical conduit, so as to allow the drilling fluid to function as a circulating refrigerant, thereby freezing solid any penetrated porefluids, freeze-stabilizing the borehole wall, and freeze-stabilizing the core samples, thus, allowing the freeze-entrapment of uncontaminated porefluids within the core samples, and, thus, encapsulating the borehole with an impermeable sheath, so as to allow elevated pump pressures and elevated annular pressures, and, thus, facilitate the hydraulic retrieval of the retrievable coresampling assembly and its load of cored rock following coring operations, and to, thus, facilitate reverse-circulation hole-opening during hole-opening operations.

* * * * *